US008414416B1

(12) United States Patent
Edwards

(10) Patent No.: US 8,414,416 B1
(45) Date of Patent: Apr. 9, 2013

(54) GOLF ACCESSORY SYSTEM

(76) Inventor: Mark Edwards, Indianapolis, IN (US)

( * ) Notice: Subject to any disclaimer, the term of this patent is extended or adjusted under 35 U.S.C. 154(b) by 104 days.

(21) Appl. No.: 13/216,806

(22) Filed: Aug. 24, 2011

(51) Int. Cl.
*A63B 57/00* (2006.01)

(52) U.S. Cl. ..... 473/286; 473/408

(58) Field of Classification Search ..... 473/308, 473/286

See application file for complete search history.

(56) References Cited

U.S. PATENT DOCUMENTS 4,787,632 A 11/1988 Nigrelli et al.
5,188,409 A * 2/1993 Forey ..... 294/19.2
6,497,327 B1 12/2002 Rindfleisch
6,572,167 B2 6/2003 Deininger
6,962,536 B2 11/2005 Hall et al.
7,854,664 B1 * 12/2010 Comrie ..... 473/282
2006/0229145 A1 * 10/2006 Dempsey ..... 473/408

* cited by examiner

*Primary Examiner* — Michael Dennis

(57) ABSTRACT

A golf accessory system having a main shaft, a divot repair tool, and a beveled or pointed cover removably attached. A shaft extension is removably attached to the first end, and a ball retriever component is disposed on the first end of the extension. A divot-pressing component is on the top end of the ball retriever. The system also features first and second scooper shafts, wherein the first ends are pivotally attached to the main shaft via a hinge and the second ends are curved towards the first end of the main shaft. The scooper shafts can pivot between at least a vertical and horizontal position. Scoops on the second end of the scooper shaft which are half-pipe in shape with an apex, wherein the apex is attached to the second end of the scooper shafts.

9 Claims, 3 Drawing Sheets

GOLF ACCESSORY SYSTEM

FIELD OF THE INVENTION

The present invention is directed to a system for combining various golf accessories, for example a ball retriever and a divot repair system.

BACKGROUND OF THE INVENTION

Some golfers find themselves toting a variety of golf tools or pieces of equipment. The present invention features a novel golf accessory system that combines a variety of tools, for example a ball retriever, a divot repair system, a cigar holder, and a club stand. The present invention is not limited to the aforementioned combined tools (e.g., the system may comprise a ball marker holder). The system of the present invention has a unique design can be stored in the umbrella storage area of a golf bag or in the bag itself.

SUMMARY

The present invention features a golf accessory system. In some embodiments, the golf accessory system comprises a main shaft having a first end and a second end, a divot repair tool disposed on the second end of the main shaft; a cover removably attached to the second end of the main shaft via a first attachment means, the cover has a first end, a second end, and a generally hollow center adapted to receive the second end of the main shaft, the second end of the cover is beveled or pointed; a shaft extension, having a first end and a second end, the second end is removably attached to the first end of the main shaft via a second attachment means; a ball retriever component disposed on the first end of the shaft extension, wherein a divot-pressing component is disposed on a top end of the ball retriever component, the divot-pressing component is a generally flat panel adapted to press down on divots; a first scooper shaft having a first end and a second end, the first end is pivotally attached to the main shaft via a hinge, the second end is curved in a first direction towards the first end of the main shaft, the first scooper shaft can pivot between at least a vertical position parallel to the main shaft and a horizontal position pivoted upwardly toward the first end of the main shaft such that the first scooper shaft is generally perpendicular to the main shaft; and a first scoop disposed on the second end of the first scooper shaft, the first scoop is half-pipe in shape with an apex, the apex is attached to the second end of the first scooper shaft.

In some embodiments, the divot repair tool comprises a pair of parallel flanges extending downwardly from the second end of the main shaft.

In some embodiments, the first attachment means includes a screw mechanism, a snap mechanism, a magnet mechanism, a clip mechanism, a latch mechanism, a tie mechanism, a hook-and-loop fastener mechanism, or a combination thereof. In some embodiments, the second attachment means includes a screw mechanism, a snap mechanism, a magnet mechanism, a clip mechanism, a latch mechanism, a tie mechanism, a hook-and-loop fastener mechanism, or a combination thereof.

In some embodiments, the ball retriever component has a top end, a bottom end, and two open side ends, the bottom end is mounted to the first end of the shaft extension.

In some embodiments, an outer surface of the divot-pressing component is textured.

In some embodiments, the golf accessory system further comprises a second scooper shaft having a first end and a second end, the first end is pivotally attached to the main shaft via a hinge, the second end is curved in a first direction towards the first end of the main shaft, the second scooper shaft can pivot between at least a vertical position wherein the second scooper shaft is parallel to the main shaft and a horizontal position wherein the second scooper shaft is pivoted upwardly toward the first end of the main shaft such that the second scooper shaft is generally perpendicular to the main shaft; and (b) a second scoop disposed on the second end of the second scooper shaft, the second scoop is half-pipe in shape with an apex, the apex is attached to the second end of the second scooper shaft.

In some embodiments, the golf accessory system further comprises a handle disposed on the main shaft above the first end of the cover.

In some embodiments, the golf accessory system further comprises a ball marker holder disposed on the main shaft, the ball marker holder comprises a generally circular indentation adapted to hold a ball marker.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
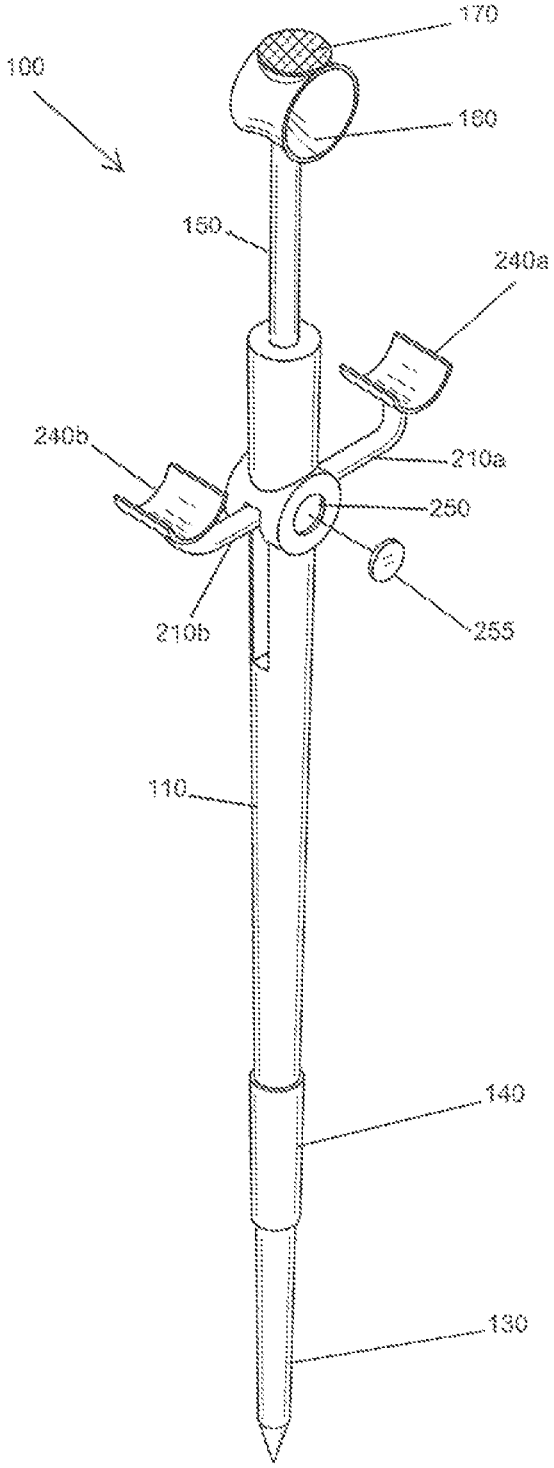
FIG. 1 is a perspective view of the golf accessory system of the present invention.
Figure 2:
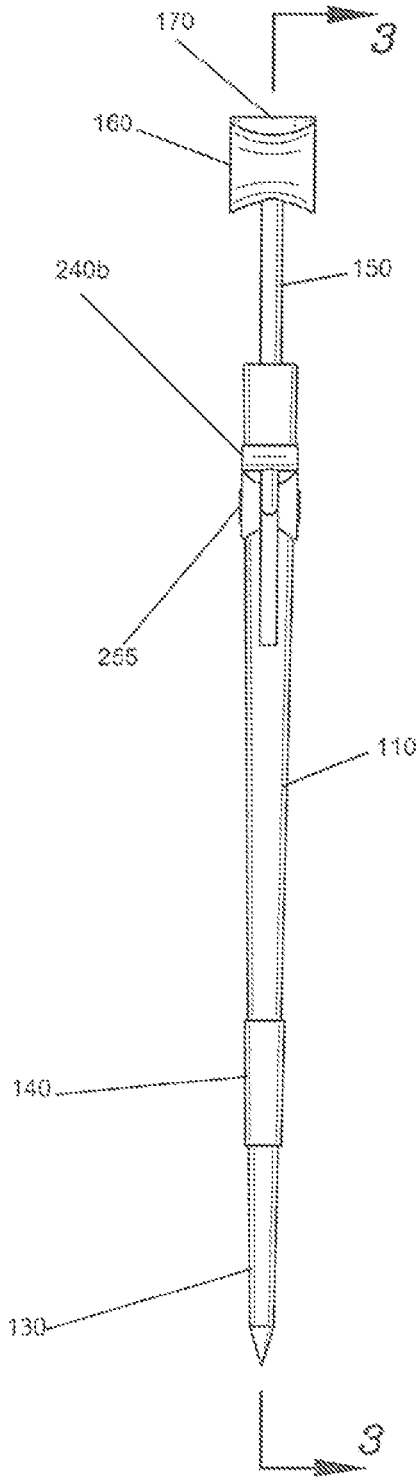
FIG. 2 is a side view of the golf accessory system of the present invention.
Figure 3:
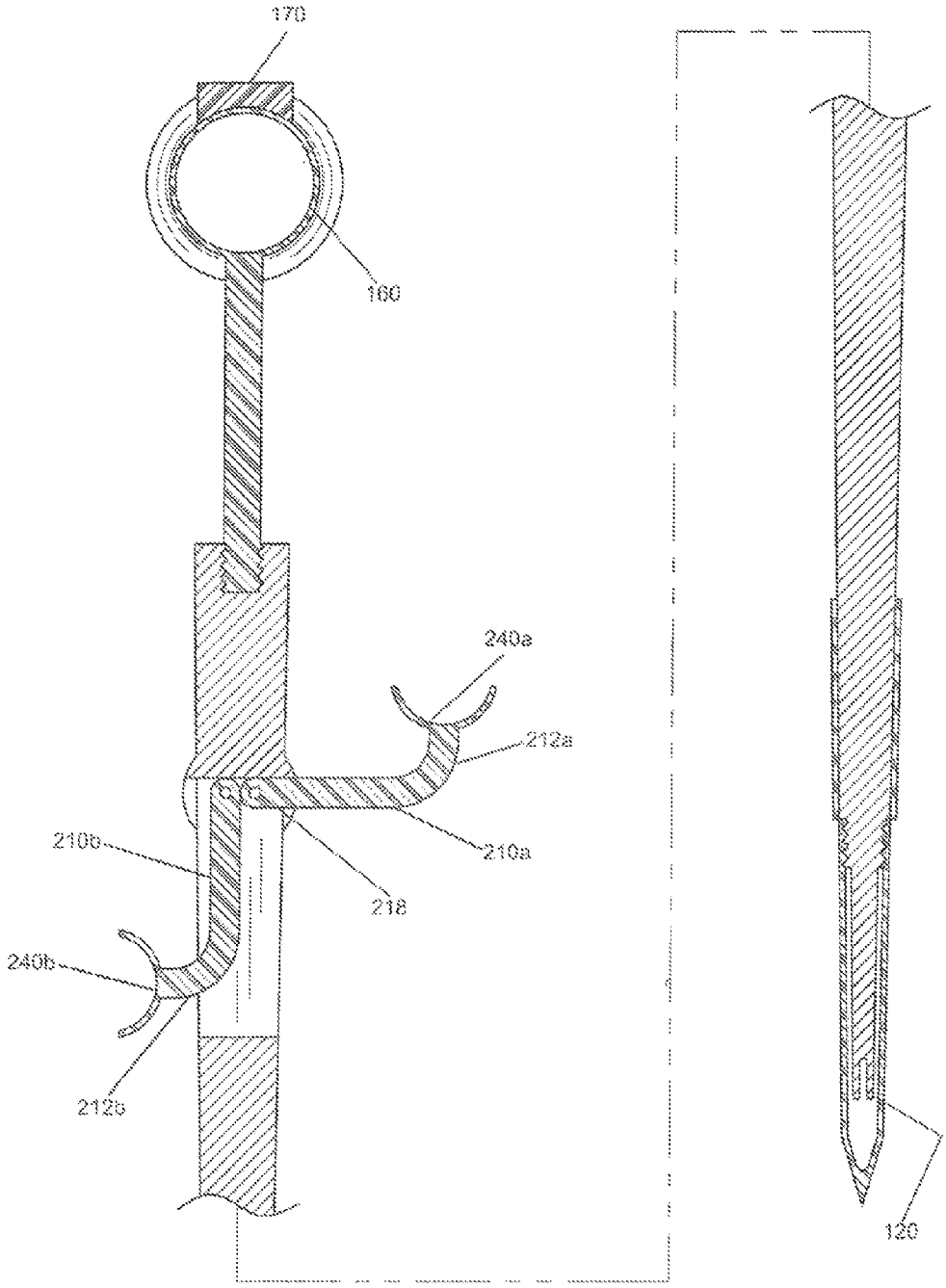
FIG. 3 is a cross-sectional view of FIG. 2 of the golf accessory system of the present invention.

Referring now to FIGS. 1-4, the present invention features a golf accessory system 100. The golf accessory system 100 comprises a main shaft 110 having a first end 111 and a second end 112 (e.g., see FIG. 4 for clarity). Disposed on the second end 112 of the main shaft 110 is a divot repair tool 120. The divot repair tool 120 may comprise a pair of parallel flanges extending downwardly from the second end 112 of the main shaft 110 as shown in FIG. 3.

Figure 4:
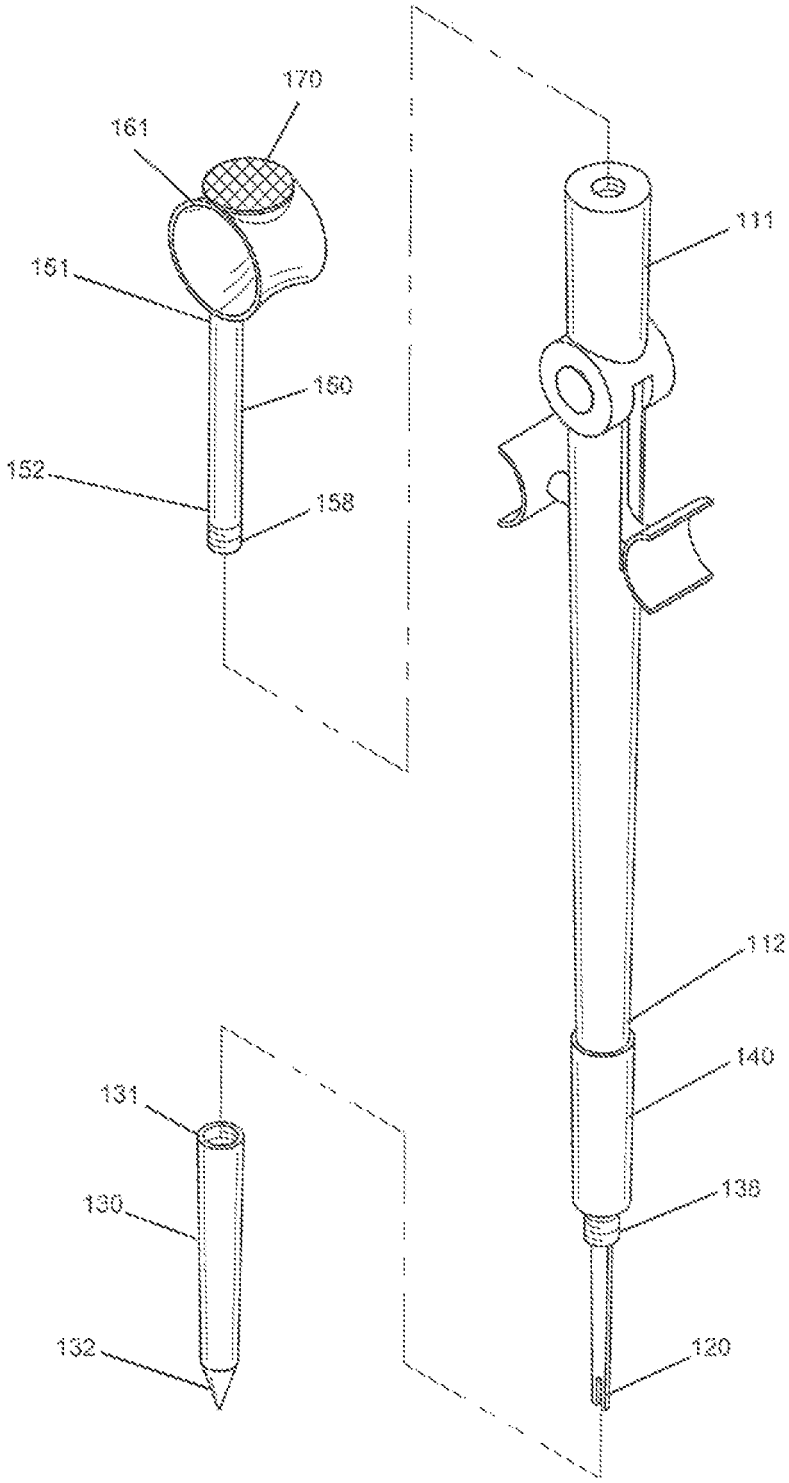
FIG. 4 is an exploded view of the golf accessory system of the present invention.

Removably attached (e.g., via a first attachment means) to the second end 112 of the main shaft 110 is a cover 130. In some embodiments, the first attachment means includes a screw mechanism (e.g., a first screw mechanism 138), a snap mechanism, a magnet mechanism, a clip mechanism, a latch mechanism, a tie mechanism, a hook-and-loop fastener mechanism, the like, or a combination thereof. The first attachment means is not limited to the aforementioned attachment means. FIG. 4 shows the cover 130 removed from the second end 112 of the main shaft 110.

The cover 130 has a first end 131, a second end 132, and a generally hollow center. The center is adapted to receive the second end 112 of the main shaft 110. The first end 131 of the cover 130 is open, and the second end 132 of the cover 130 is closed (e.g., see FIG. 3). In some embodiments, the second end 132 of the cover 130 is beveled or pointed.

In some embodiments, a handle 140 is disposed on the main shaft 110 above the first end 131 of the cover 130.

Removably attached to the first end 111 of the main shaft 110 is a shaft extension 150 having a first end 151 and a second end 152. The second end 152 of the shaft extension 150 is removably attached to the first end 111 of the main shaft 110 via a second attachment means. In some embodiments, the second attachment means includes a screw mechanism (e.g., a second screw mechanism 158), a snap mechanism, a magnet mechanism, a clip mechanism, a latch mechanism, a tie mechanism, a hook-and-loop fastener mechanism, the like, or a combination thereof. The second attachment means is not limited to the aforementioned attachment means.

Disposed on the first end 151 of the shaft extension 150 is a ball retriever component 160. Golf ball retrievers are well known to one of ordinary skill in the art. For example, the ball retriever component 160 comprises a ring adapted to snugly (and temporarily) hug a golf ball. The ball retriever component 160 has a top end 161, a bottom end, and two open side ends. The bottom end is mounted to the first end 151 of the shaft extension 150. The two open side ends are accessible.

Disposed on the top end 161 of the ball retriever component 160 is a divot-pressing component 170. The divot-pressing component 170 is a generally flat panel (e.g., circular flat panel) adapted to press down on divots. In some embodiments, the outer surface of the divot-pressing component 170 is textured.

Pivotally attached to the main shaft 110 are a first scooper shaft 210*a* and a second scooper shaft 210*b* (e.g., via hinges 218). The scooper shafts 210 can pivot between at least a vertical position wherein the scooper shafts 210 are parallel to the main shaft 110 (e.g., see FIG. 4, FIG. 3) and a horizontal position wherein the scooper shafts 210 are pivoted upwardly toward the first end 111 of the main shaft 110 such that the scooper shafts 210 are generally perpendicular to the main shaft 110 (e.g., see FIG. 3, FIG. 1).

The first ends of the scooper shafts 210 are pivotally attached to the main shaft 110 and the second ends 212 of the scooper shafts 210 are curved in a first direction. The first direction refers to in the direction of the first end 111 of the main shaft 110 when the scooper shafts 210 are pivoted to the horizontal position (e.g., see FIG. 3).

A first scoop 240*a* is disposed on the second end 212*a* of the first scooper shaft 210*a* and a second scoop 240*b* is disposed on the second end 212*b* of the second scooper shaft 210*b*. The scoops 240 are generally half-pipe in shape. The apexes of the arc of the half-pipe-shaped scoops 240 are attached to the second ends 212 of the scooper shafts 210. The scoops 240 may function to hold a cigar, for example.

In some embodiments, a ball marker holder 250 is disposed on the main shaft 110 (e.g., near the scooper shafts 210). The ball marker holder 250 may comprise a generally circular indentation adapted to hold a ball marker 255. Ball markers are well known to one of ordinary skill in the art.

The system 100 of the present invention may be constructed in a variety of sizes. For example, in some embodiments, the main shaft 110 is sized to fit in an umbrella holder of a golf bag. In some embodiments, the main shaft 110 is between about 24 to 36 inches in length as measured from the first end 111 to the second end 112. In some embodiments, the main shaft 110 is more than about 36 inches in length or less than about 24 inches in length as measured from the first end 111 to the second end 112.

As used herein, the term "about" refers to plus or minus 10% of the referenced number. For example, an embodiment wherein the main shaft 110 is about 30 inches in length includes a main shaft 110 that is between 27 and 33 inches in length.

The disclosures of the following U.S. Patents are incorporated in their entirety by reference herein: U.S. Pat. No. 4,787,632; U.S. Pat. No. 6,497,327; U.S. Pat. No. 6,572,167; U.S. Pat. No. 6,962,536; U.S. Patent Application No. 2006/0229145.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A golf accessory system 100 comprising:

(a) a main shaft 110 having a first end 111 and a second end 112

(b) a divot repair tool 120 disposed on the second end 112 of the main shaft 110;

(c) a cover 130 removably attached to the second end 112 of the main shaft 110 via a first attachment means, the cover 130 has a first end 131, a second end 132, and a generally hollow center adapted to receive the second end 112 of the main shaft 110, the second end 132 of the cover 130 is beveled or pointed;

(d) a shaft extension 150 having a first end 151 and a second end 152, the second end 152 is removably attached to the first end 111 of the main shaft 110 via a second attachment means;

(e) a ball retriever component 160 disposed on the first end 151 of the shaft extension 150, wherein a divot-pressing component 170 is disposed on a top end 161 of the ball retriever component 160, the divot-pressing component 170 is a generally flat panel adapted to press down on divots;

(f) a first scooper shaft 210*a* having a first end 211*a* and a second end 212*a*, the first end 211*a* is pivotally attached to the main shaft 110 via a hinge 218, the second end 212*a* is curved in a first direction towards the first end 111 of the main shaft 110, the first scooper shaft 210*a* can pivot between at least a vertical position parallel to the main shaft 110 and a horizontal position pivoted upwardly toward the first end 111 of the main shaft 110 such that the first scooper shaft 210*a* is generally perpendicular to the main shaft 110; and (g) a first scoop 240*a* disposed on the second end 212*a* of the first scooper shaft 210*a*, the first scoop 240*a* is half-pipe in shape with an apex, the apex is attached to the second end 212*a* of the first scooper shaft 210*b*.

2. The system 100 of claim 1, wherein the divot repair tool 120 comprises a pair of parallel flanges extending downwardly from the second end 112 of the main shaft 110.

3. The system 100 of claim 1, wherein the first attachment means includes a screw mechanism, a snap mechanism, a magnet mechanism, a clip mechanism, a latch mechanism, a tie mechanism, a hook-and-loop fastener mechanism, or a combination thereof.

4. The system 100 of claim 1, wherein the second attachment means includes a screw mechanism, a snap mechanism, a magnet mechanism, a clip mechanism, a latch mechanism, a tie mechanism, a hook-and-loop fastener mechanism, or a combination thereof.

5. The system 100 of claim 1, wherein the ball retriever component 160 has a top end 161, a bottom end, and two open side ends, the bottom end is mounted to the first end 151 of the shaft extension 150.

6. The system 100 of claim 1, wherein an outer surface of the divot-pressing component 170 is textured.

7. The system 100 of claim 1 further comprising: (a) a second scooper shaft 210*b* having a first end 211*b* and a second end 212*b*, the first end 211*b* is pivotally attached to the main shaft 110 via a hinge 218, the second end 212*b* is curved in a first direction towards the first end 111 of the main shaft 110, the second scooper shaft 210*b* can pivot between at least a vertical position wherein the second scooper shaft 210*b* is parallel to the main shaft 110 and a horizontal position wherein the second scooper shaft 210*b* is pivoted upwardly toward the first end 111 of the main shaft 110 such that the second scooper shaft 210*b* is generally perpendicular to the main shaft 110; and (b) a second scoop 240*b* disposed on the second end 212*b* of the second scooper shaft 210*b*, the second scoop 240*b* is half-pipe in shape with an apex, the apex is attached to the second end 212*b* of the second scooper shaft 210*b*.

8. The system 100 of claim 1 further comprising a handle 140 disposed on the main shaft 110 above the first end 131 of the cover 130.

9. The system 100 of claim 1 further comprising a ball marker holder 250 disposed on the main shaft 110, the ball marker holder 250 comprises a generally circular indentation adapted to hold a ball marker 255.

* * * * *